US011536025B2

(12) United States Patent
Engelen

(10) Patent No.: US 11,536,025 B2
(45) Date of Patent: Dec. 27, 2022

(54) BRIDGING CONNECTORS FOR SUSPENDED CEILING SYSTEMS

(71) Applicant: ROCKWOOL INTERNATIONAL A/S, Hedehusene (DK)

(72) Inventor: Vicky Engelen, Hedehusene (DK)

(73) Assignee: ROCKWOOL INTERNATIONAL A/S, Hedehusene (DK)

( * ) Notice: Subject to any disclaimer, the term of this patent is extended or adjusted under 35 U.S.C. 154(b) by 0 days.

(21) Appl. No.: 17/052,016

(22) PCT Filed: Apr. 30, 2019

(86) PCT No.: PCT/IB2019/053539
§ 371 (c)(1),
(2) Date: Oct. 30, 2020

(87) PCT Pub. No.: WO2019/211751
PCT Pub. Date: Nov. 7, 2019

(65) Prior Publication Data

US 2021/0095468 A1 Apr. 1, 2021

(30) Foreign Application Priority Data

May 1, 2018 (EP) ..... 18170283

(51) Int. Cl.
*E04B 9/12* (2006.01)
*E04B 9/06* (2006.01)
*E04B 9/30* (2006.01)

(52) U.S. Cl.
CPC ..... *E04B 9/127* (2013.01); *E04B 9/068* (2013.01); *E04B 9/30* (2013.01)

(58) Field of Classification Search
CPC ..... E04B 9/127; E04B 9/068; E04B 9/30
USPC ..... 52/712, 506.07, 506.06; 248/316.7, 317, 248/343, 221.11
See application file for complete search history.

(56) References Cited

U.S. PATENT DOCUMENTS 4,122,762 A * 10/1978 Williams ..... E04B 9/12 248/343
4,715,161 A 12/1987 Carraro et al.
5,045,985 A * 9/1991 Russo ..... E04B 9/006 362/366

(Continued)

FOREIGN PATENT DOCUMENTS

GB 994701 A 6/1965
RU 141 975 U8 9/2014
WO WO 2017/062944 A1 4/2017

OTHER PUBLICATIONS

International Search Report for PCT/IB2019/053539 dated Jun. 19, 2019.

(Continued)

*Primary Examiner* — Brent W Herring
(74) *Attorney, Agent, or Firm* — Birch, Stewart, Kolasch & Birch, LLP

(57) ABSTRACT

Bridging connector (1) for a suspended ceiling system, and a suspended ceiling system comprising the bridging connector. The bridging connector comprises a beam connector (2) joined to a wall engagement element (3) arranged at an angle of essentially 90 degrees to the beam connector (2), the wall engagement element (3) further comprising a depressed beam engagement element portion (4).

16 Claims, 5 Drawing Sheets

(56) References Cited

Figure 1:
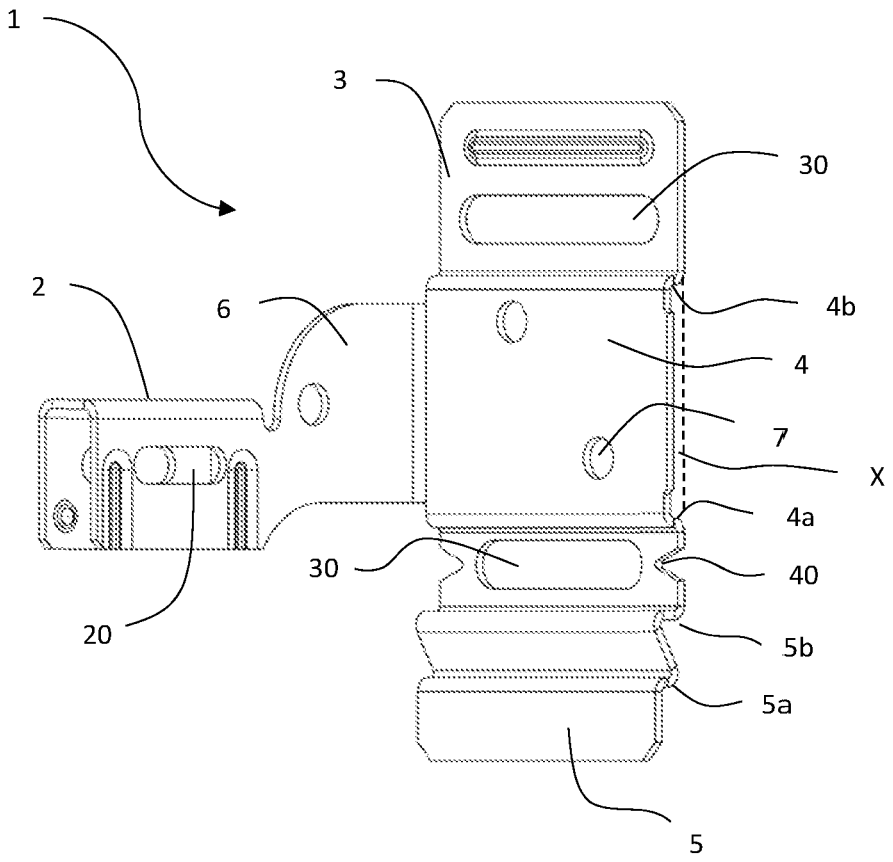

U.S. PATENT DOCUMENTS 5,046,294 A * 9/1991 Platt ..... E04B 9/127 52/506.06
5,195,289 A * 3/1993 LaLonde ..... E04F 19/02 52/506.06
5,505,419 A * 4/1996 Gabrius ..... H02G 3/125 248/343
5,618,017 A * 4/1997 De Boer ..... E04B 9/006 248/201
5,746,507 A * 5/1998 Lee ..... F21V 21/04 362/147
5,937,605 A 8/1999 Wendt
6,341,466 B1 * 1/2002 Kehoe ..... E04B 9/006 52/712
6,729,083 B1 * 5/2004 Soyko ..... E04D 13/0305 248/298.1
6,997,364 B2 * 2/2006 Oetlinger ..... B26D 7/1818 225/104
7,552,567 B2 * 6/2009 Ingratta ..... E04B 9/06 52/506.07
7,788,875 B2 * 9/2010 Wendt ..... E04B 9/30 52/712
8,177,176 B2 * 5/2012 Nguyen ..... H02G 3/20 248/200.1
8,453,407 B2 * 6/2013 Tedesco ..... E04B 9/127 52/506.07
8,528,292 B2 * 9/2013 Morey ..... E04C 3/02 52/655.1
8,939,418 B2 * 1/2015 Green ..... F21V 21/04 248/343
9,187,898 B1 * 11/2015 Underkofler ..... E04B 9/30
9,255,403 B1 2/2016 Lehane et al.
9,663,948 B2 * 5/2017 Lehane ..... E04B 9/127
10,584,837 B2 * 3/2020 O'Brien ..... F21V 21/22
10,907,843 B2 * 2/2021 Penlesky ..... F24F 7/007
10,988,953 B2 * 4/2021 Underkofler ..... E04B 9/08
2005/0160696 A1 * 7/2005 Kelly ..... E04B 9/067 52/712
2006/0096219 A1 5/2006 Ingratta et al.
2011/0146194 A1 6/2011 Tedesco et al.
2011/0283634 A1 11/2011 Underkofler et al.
2012/0017531 A1 1/2012 Bankston
2013/0227908 A1 * 9/2013 Gulbrandsen ..... E04B 9/10 52/665
2014/0000205 A1 1/2014 Underkofler et al.
2017/0362828 A1 * 12/2017 Czyzewicz ..... E04B 9/006
2018/0119907 A1 * 5/2018 O'Brien ..... F21S 8/026

OTHER PUBLICATIONS

Written Opinion of the International Searching Authority for PCT/IB2019/053539 dated Jun. 19, 2019.
Russian Search Report for Russian Application No. 2020139063, dated Nov. 8, 2021, with an English translation.

* cited by examiner

BRIDGING CONNECTORS FOR SUSPENDED CEILING SYSTEMS

The present invention relates to bridging connectors for a suspended ceiling system and suspended ceiling systems comprising such bridging connectors.

Bridging connectors known in the art comprise a beam connector for connecting to a beam of a grid system, and a wall engagement element arranged at an angle of essentially 90 degrees to the beam connector for connecting to a wall, thereby connecting the beam to the wall. Other bridging connectors comprise a beam connector for connecting to a first beam of a grid system and a beam engagement element arranged at an angle of essentially 90° to the beam connector for connecting to a second beam in the grid system, thereby connecting the two beams to each other.

Examples of such connectors can be found in U.S. Pat. No. 9,255,403, in which FIGS. 1 to 8 show a connector in various forms for connecting a beam to a wall angle. FIGS. 9 to 11 show a different connector which is for connecting two beams to each other. This document does not disclose the use of a single type of connector for fulfilling both functions.

US2014/0000205 and WO 2017/062944 disclose other bridging connectors for connection of a beam to a wall angle.

Another example of a connector can be found in US patent application no. 2006/0096219, which discloses a seismic perimeter clip for suspended ceiling grid. The perimeter clip comprises first and second legs bent at 90 degrees with respect to each other. The first leg is for engaging the vertical leg of a wall angle. The second leg is adapted to receive a bead of a beam. The perimeter clip is not suitable for connecting two beams of a suspended ceiling at right angles. Although the second leg is adapted to receive a beam, the first leg is not. The first leg includes a lower portion and a tongue which are designed to fit over a wall angle, but are not able to receive the bead of a beam. For a suspended ceiling system it is important that beams are not tilting in relation to each other, and this is not possible to safeguard with this prior art connector.

SUMMARY OF THE INVENTION

The known connectors are quite specific to the purpose, which means that an installer of suspended ceiling systems must have several different connectors for different purposes, which makes the installation process more complex and time-consuming.

It is hence an object of the present invention to provide a bridging connector, which is versatile and can be used in different configurations.

According to a first aspect of the invention there is provided a bridging connector for a suspended ceiling system, comprising:

a beam connector joined to a wall engagement element arranged at an angle of essentially 90 degrees to the beam connector, the beam connector being a saddle type connector of mainly U-shape, and the wall engagement element further comprising a depressed beam engagement portion.

According to a second aspect of the invention there is provided a bridging connector for a suspended ceiling system, comprising:

a beam connector joined to a wall engagement element arranged at an angle of essentially 90 degrees to the beam connector, the wall engagement element further comprising a depressed beam engagement portion, wherein the wall engagement element further comprises a wall angle engagement portion, wherein the wall angle engagement portion comprises a first stop element and a second stop element.

According to a third aspect of the invention there is provided a suspended ceiling system comprising a bridging connector according to the invention, further comprising:

a first beam connected to the beam connector of the bridging connector, the first beam comprising a flange, a second beam connected to the beam engagement element of the bridging connector, the second beam comprising a flange, a ceiling tile positioned on flanges of the first and second beams.

According to a fourth aspect of the invention there is provided a suspended ceiling system comprising a bridging connector according to the invention, further comprising a beam connected to the beam connector of the bridging connector, the first beam comprising a flange, a wall angle adapted for connection to a wall and engaging the wall angle engagement portion of the bridging connector, the wall angle further comprising a flange, a ceiling tile positioned on flanges of the beam and the wall angle.

According to a fifth aspect of the invention there is provided a suspended ceiling system comprising at least two bridging connectors, the bridging connectors having the same structure and each bridging connector comprising:

a beam connector joined to a wall engagement element arranged at an angle of essentially 90 degrees to the beam connector, the wall engagement element further comprising a depressed beam engagement portion, the suspended ceiling system comprising a first beam connected to the beam connector of a first bridging connector, the first beam comprising a flange, a second beam connected to the beam engagement element of the first bridging connector, the second beam comprising a flange, a ceiling tile positioned on flanges of the first and second beams, a third beam connected to the beam connector of a second bridging connector, the third beam comprising a flange, a wall angle adapted for connection to a wall and engaging the wall angle engagement portion of the second bridging connector, the wall angle further comprising a flange, a ceiling tile positioned on flanges of the third beam and the wall angle The object of providing a bridging connector, which is versatile and can be used in different configurations is firstly achieved by the wall engagement element further comprising a depressed beam engagement portion. The depressed beam engagement portion is tailored for accommodating part of a beam. Hereby the same bridging connector can be used both as a connector connecting a beam to a wall, and function as a connector between two beams for connecting these at an angle. This means that the installer does not need different connectors for connecting two beams and for connecting a beam and a wall angle, respectively, as the same connector can be used for both purposes.

Use of a saddle type connector has the advantage that it enables a quick connection between the bridging connector and the beam.

Preferred bridging connectors meet the requirements of both the first and second aspects of the invention.

The wall engagement element may further comprise a wall angle engagement portion. Such an embodiment enables positive and well-defined engagement between the bridging connector and a potential wall angle. Wall angles are often used to provide an aesthetically pleasing transition from a suspended ceiling to a wall. Further wall angles are often used for supporting ceiling tiles along the wall.

According to a second aspect the wall angle engagement portion comprises a first stop element and a second stop element. Hereby it is possible to position the bridging connector in different positions relatively to the wall angle. This eliminates the need for different types of bridging connectors for different types of wall angles or for different positions of the connector relative to the same wall angle.

The wall angle engagement portion will normally be positioned below the depressed beam engagement portion ("below" being in relation to their positions when the bridging connector is in use).

The first and second stop elements may be steps formed in the wall angle engagement portion. This provides for simple manufacturing by bending of the wall angle engagement portion.

In an alternative embodiment the first and second stop elements are indentations formed in the wall angle engagement portion. This may be cheaper in production and potentially save material.

The beam engagement portion is depressed in relation to the plane of the wall engagement element. Namely, its surface is displaced by a distance in relation to the plane of the wall engagement element. It forms a recess in the surface of the wall engagement element. This means that it can accommodate the bead of a beam. The lower and upper bounds of the recess are generally formed by first and second abutments.

In an embodiment of the bridging connector the beam engagement portion comprises a first abutment and a second abutment. Hereby an even more versatile bridging connector is provided in that the bridging connector can be connected to a beam at two different, well-defined positions at the respective abutments connecting in first and second vertical positions. This means that the same bridging connector can be used in different configurations, and the need for a variety of different connectors is eliminated or at least reduced.

The depressed beam engagement portion will have a height which is greater than the height of the bead of the beam which is to be accommodated within the recess. The height of the beam engagement portion is therefore defined by the distance between the first and second abutments and this distance is generally greater than the height of the bead of the beam to be accommodated.

In an embodiment of the bridging connector the wall angle engagement portion supplementarily or alternatively comprises a tongue off-set from a plane of the wall engagement element. Hereby the wall engagement element is adapted to straddle the wall angle and provide at least a certain degree of fixation of the bridging connector to a wall angle. This can be advantageous for installers to have a non-permanent connection before making more permanent fixation of the wall engagement element to a wall, e.g. by means of a screw.

According to an embodiment the wall engagement element further comprises fracture assistance weakenings. The fracture assistance weakenings may be one or more cut-outs or stitches in the wall engagement element to weaken the wall engagement element at the wall angle engagement portion to provide a well-defined line of fracture. Hereby it is possible to break away the wall angle engagement portion by hand without the use of tools. In some situations, it is advantageous to remove the wall angle engagement portion when this is not to be used, e.g. if it would be in the way connecting two beams at different levels.

The bridging connector may be made up of different parts, which are assembled to form the bridging connector, but according to a particularly simple embodiment the bridging connector is a unitary piece.

The bridging connector may be made of any suitable material, such as plastics or reinforced plastics which may be suitable for 3D printing. According to an embodiment, however, the bridging connector is made of sheet metal, which is relatively light and strong, and can be bent in various forms and shapes with common tools, and further metal has good fire stability.

According to an embodiment the wall engagement element of the bridging connector comprises an aperture adapted for receiving a fastener making it easier for the installer to mount a fastener. The aperture may be an elongated hole to facilitate some adjustment. The fastener may for example be a screw.

An aspect of the invention relates to a suspended ceiling system comprising the bridging connector. The suspended ceiling system further comprises a first beam connected to the beam connector of the bridging connector, the first beam comprising a flange, a second beam connected to the beam engagement portion of the bridging connector, the second beam comprising a flange, and a ceiling tile positioned on flanges of the first and second beams.

Another aspect of the invention relates to a suspended ceiling system comprising a bridging connector comprising a wall angle engagement portion as outlined above, further comprising a beam connected to the beam connector of the bridging connector, the first beam comprising a flange, a wall angle adapted for connection to a wall and engaging the wall angle engagement portion of the bridging connector, the wall angle further comprising a flange, a ceiling tile positioned on flanges of the beam and the wall angle.

The versatility of the bridging connectors of the invention means that it is possible to provide a suspended ceiling system which uses connectors which are all of the same configuration, for connecting beams to each other and for connecting beams to the wall.

The beam may be of the type denoted tee runners. Such tee runners are beams of T-shaped cross section with a stem or web and flanges to each side of the stem at one end thereof. The other end of the stem may comprise a bulb or bead at the other end of the stem part. Such tee runners are commonly used in suspended ceiling systems.

The ceiling tiles may be made of mineral wool, such as stone wool or glass wool, which provides favourable acoustic properties by providing sound absorption thereby optimizing room acoustics. The thickness of such tiles is generally between 15 and 50 mm, and other dimensions generally 600×600 mm, 1200×600 mm or 1800×600 mm. The area weight is generally below 10 kg/m$^2$, and often in the range of 2 to 8 kg/m$^2$, such as 3-5 kg/m$^2$.

Alternatively, the ceiling tiles may be metal panels, wet felt ceiling tiles or gypsum boards.

Figure 2A:
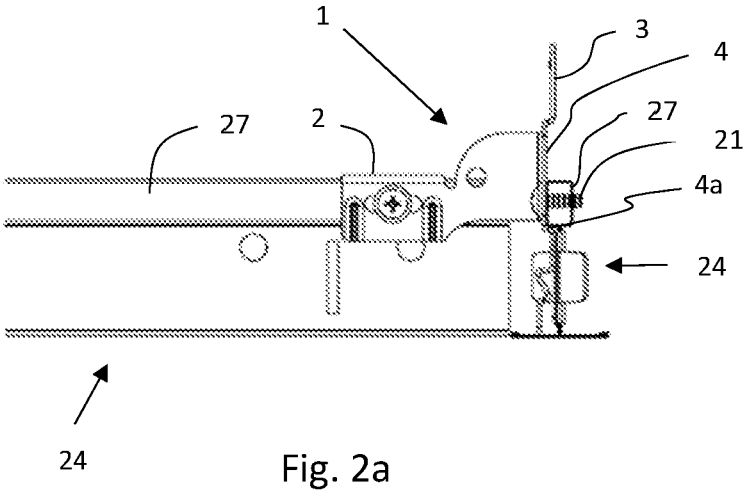
Figure 2B:
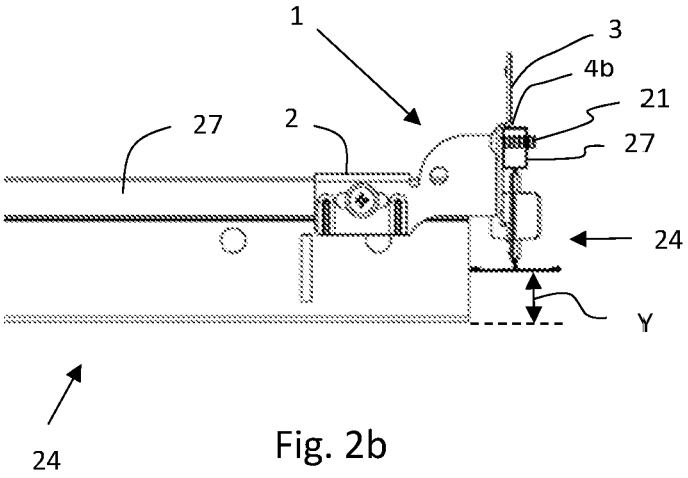
Figure 2C:
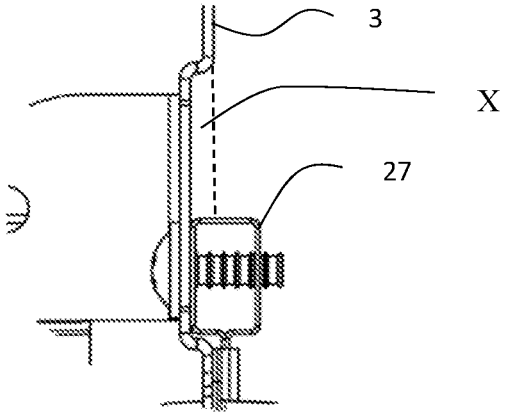
Figure 3A:
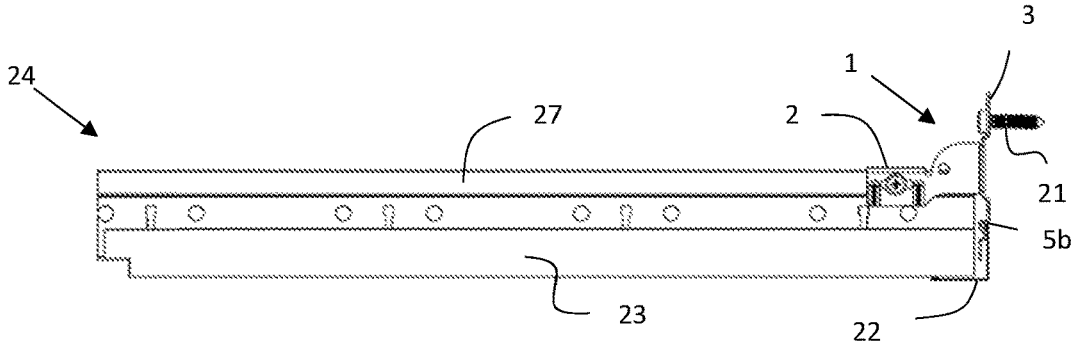
Figure 3B:
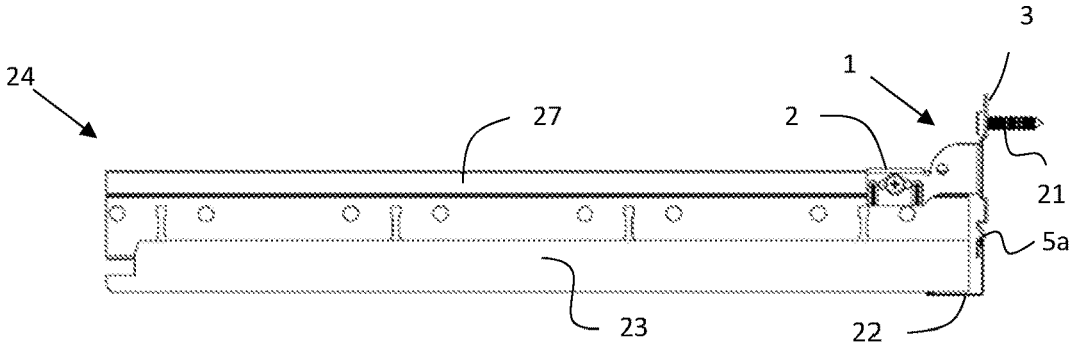
Figure 4:
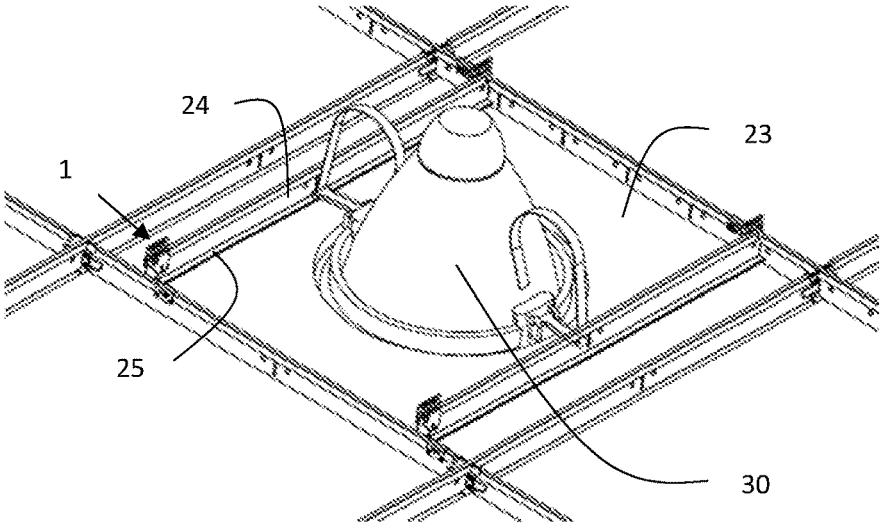
Figure 5:
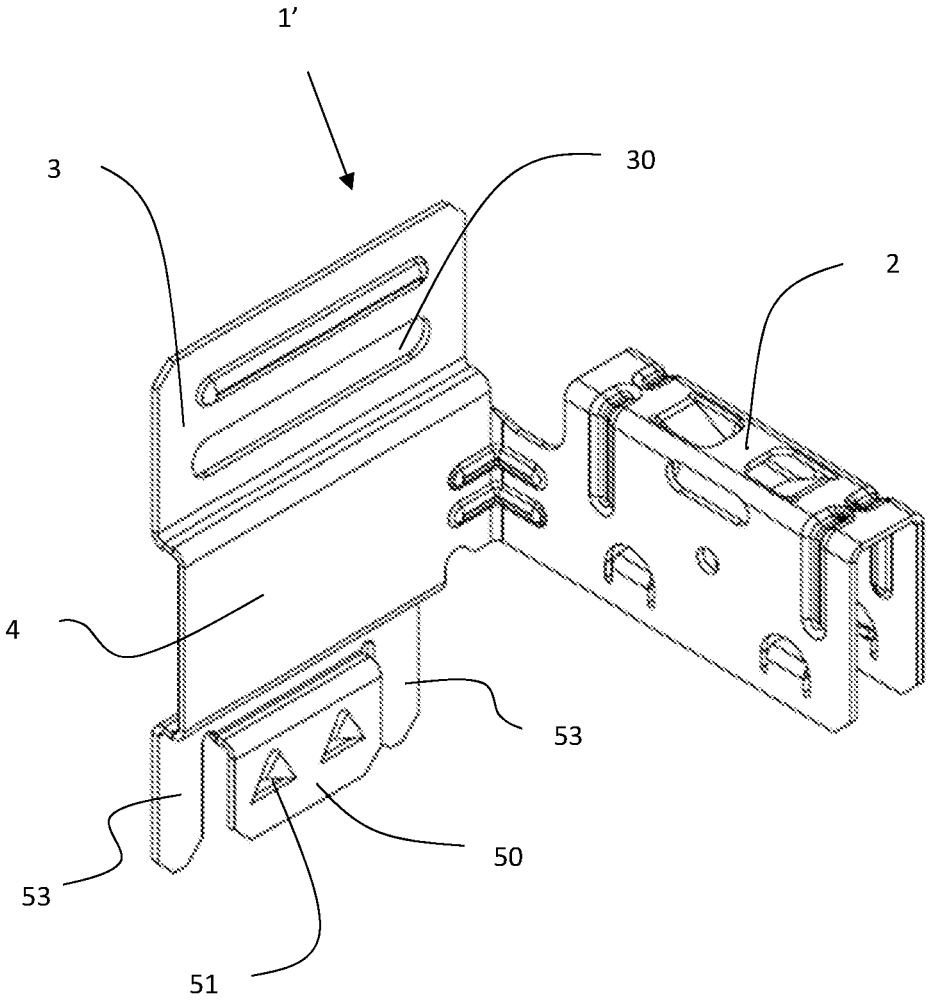
Figure 6:
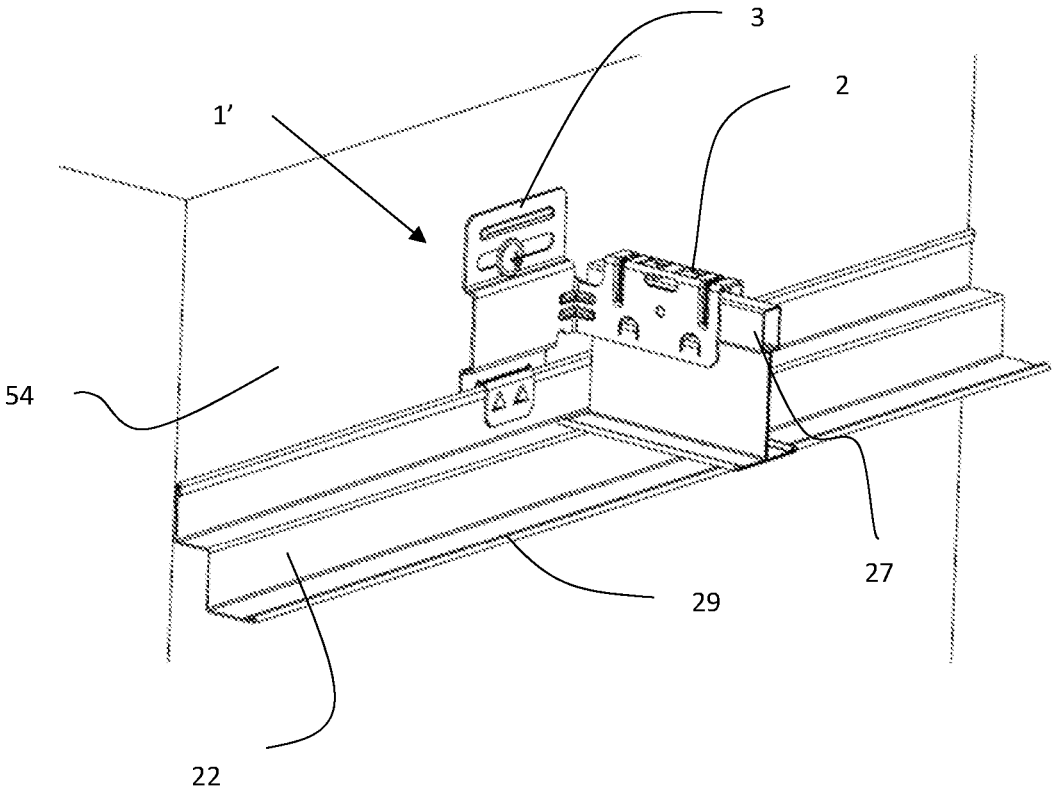
Figure 7:
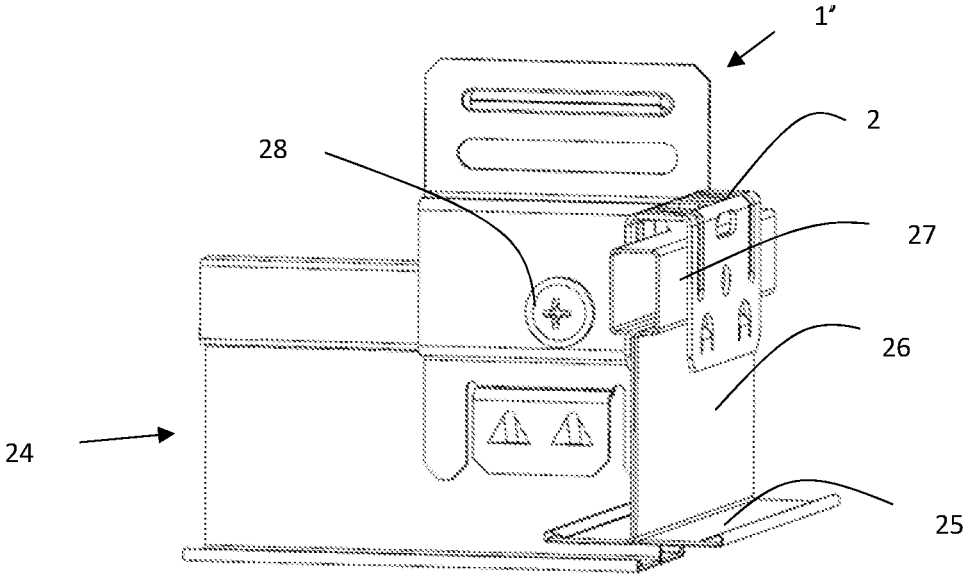

In the following, embodiments of the invention will be described in more detail with reference to the drawings in which:

FIG. 1 shows a bridging connector according to a first embodiment,

FIG. 2*a* is an illustration of part of a suspended ceiling system using the bridging connector of FIG. 1 in a first position, FIG. 2*b* is an illustration of part of a suspended ceiling system using the bridging connector of FIG. 1 in a second position, FIG. 2*c* is an enlarged detail of FIG. 2*a*, FIG. 3*a* is an illustration of part of a suspended ceiling system using the bridging connector of FIG. 1 in a second way—first position, FIG. 3*b* is an illustration of part of a suspended ceiling system using the bridging connector of FIG. 1 in a second way—second position, FIG. 4 is an illustration of part of a suspended ceiling system using the bridging connector of FIG. 1 in a third way, FIG. 5 shows a bridging connector according to a second embodiment, FIG. 6 shows the bridging connector of FIG. 5 connecting a wall angle and a beam, and FIG. 7 shows the bridging connector of FIG. 5 connecting two beams at an angle.

The bridging connector 1 illustrated in FIG. 1 comprises a beam connector 2 and a wall engagement element 3. The beam connector 2 is joined to the wall engagement element 3 via a web part 6. The beam connector 2 and the wall engagement element 3 are connected at an angle of 90 degrees as illustrated. The beam connector 2 is a saddle type connector of mainly U-shape. The beam connector 2 comprises a cut-out 20 for receiving a fastener. The wall engagement element 3 is fitted with apertures 30 to receive a fastener for connection to a wall. Fracture assistance weakenings 40, here in the form of V-shaped cut-outs, are arranged at the lower part of the bridging connector to facilitate breaking away of a lower part of the connector, should this be in the way in certain installations. The fracture assistance weakenings 40 makes it possible to break away this lower part by hand, i.e. without using tools. The wall engagement element 3 further comprises a beam engagement portion 4. The beam engagement portion 4 is provided with a first abutment 4*a* and a second abutment 4*b*. The beam engagement portion 4 is provided with holes 7 for receiving a fastener. The beam engagement portion 4 is depressed by a distance X in relation to the plane of the wall engagement element 3. The bridging connector is further provided with a wall angle engagement portion 5. The wall angle engagement portion 5 is provided with a first stop element 5*a* and a second stop element 5*b*. The first and second stop elements are provided as bent portions of the wall angle engagement portion 5 thereby providing steps in the wall angle engagement portion.

Part of a suspended ceiling system incorporating the bridging connector 1 is shown in FIG. 2*a*. The beam connector 2 is connected to a bead 27 of a beam 24. Arranged at right angles to this beam 24 is another beam 24. The bead 27 of this beam 24 is arranged in the depressed beam engagement portion 4. A lower edge of the bead 27 is positioned abutting the first abutment 4*a* of the depressed beam engagement portion 4. A screw 21 introduced through the hole 7 into the bead 27 and thereby firmly connects the beam 24 to the bridging connector 1. The two beams are at the same level in this position, so the lower face of the connected beams are flush.

Similarly, part of a suspended ceiling system incorporating the bridging connector 1 is shown in FIG. 2*b*, but here the two beams are arranged at different levels off-set by a distance Y, such as 15 mm. The beam connector 2 is connected to a bead 27 of a beam 24. Arranged at right angles to this beam 24 is another beam 24. The bead 27 of this beam 24 is arranged in the depressed beam engagement portion 4. An upper edge of the bead 27 is positioned abutting the second abutment 4*b* of the depressed beam engagement portion 4. A screw 21 introduced through the hole 7 into the bead 27 and thereby firmly connects the beam 24 to the bridging connector 1.

An enlarged detail of FIG. 2*a* is seen in FIG. 2*c*. In this illustration, it is more clearly seen that the beam engagement portion 4 is depressed by a distance X to accommodate the bead 27 of the beam. The distance X is adapted for the width of the bead 27. As an example, a common width of the bead of the beam 24 for suspended ceilings is 6.5 mm, and the distance X of the depression slightly less than half of this, e.g. 2 to 3.2 mm, taking into account the thickness of the material of the beam and potential embossing or stitching of the beam. Often such beams are made of folded sheet metal where the central web portion is double layer.

Part of a suspended ceiling system incorporating the bridging connector 1 is seen in FIG. 3*a*. The wall engagement element 3 of the bridging connector 1 is connected to a wall via a screw 21. The beam connector 2 is connected to a bead 27 of a beam 24. A wall angle 22 is fixed to the wall via means not shown in the drawing. An upper part of the wall angle is abutting the second stop element 5*b* of the bridging connector 1. In this configuration there is a well-defined first distance between the top of the wall angle 22 and the top of the beam connector 2. A tile 23 (having so-called E-edge) is arranged to rest on flanges of the wall angle 22 and the beam 24.

Part of a suspended ceiling system incorporating the bridging connector in another configuration is seen in FIG. 3*b*. The wall engagement element 3 of the bridging connector 1 is connected to a wall (not shown) via a screw 21. The beam connector 2 is connected to the bead 27 of the beam 24. The wall angle 22 fixed to the wall via means not shown in the drawing. An upper part of the wall angle is abutting the first stop element 5*a* of the bridging connector 1. In this configuration there is a well-defined second distance between the top of the wall angle 22 and the top of the beam connector 2. This means it is possible to fit a ceiling tile 23 with another edge configuration (here illustrated with a tile having the so-called X-edge). The flanges of the beam are arranged in a groove at the edge of the ceiling tile, thereby concealing the beam.

Part of a suspended ceiling system incorporating the bridging connector in another configuration is seen in FIG. 4. Ceiling tiles 23 are often made of materials that are not strong enough to support the weight of lamps or other equipment, so the weight of such equipment must be distributed to the beams of the suspended ceiling grid. For this purpose beams 24 are arranged on top of the tile 23 to hold a lamp 30. The beam 24 holding the lamp 30 is connected to another beam of the suspended ceiling grid at right angles via the bridging connector 1. The top of the beam is abutting the second abutment 4*b* of the beam engagement element 4, and the beam 24 is fixed to the beam engagement element 4 using a screw. In this position the flange 25 is above the top of the tile 23, so the beam 24 is out of the way of the ceiling tile.

A bridging connector 1' according to another embodiment is seen in FIG. 5. The beam connector 2 has a slightly different design, but the same function. The wall angle engagement portion also has a slightly different design with a tongue 50 and prongs 53. The tongue 50 and prongs 53 are adapted to engage a wall angle by straddling the top of the wall angle. The tongue 50 comprises indentations 51 functioning as first stop.

FIG. 6 illustrates part of a suspended ceiling system incorporating the bridging connector 1 of FIG. 5. The wall engagement element 3 of the bridging connector 1 is connected to a wall 54 via a screw 21. The beam connector 2 is connected to a beam 24. The wall angle 22 is fixed to the wall via means not shown in the drawing. The wall angle 22 in the illustrated embodiment is stepped to provide a recess near the wall and further is provided with a wall angle flange 29. An upper part of the wall angle is straddled by the tongue 50 and prongs to a second stop element of the bridging connector 1. In this configuration there is a well-defined first distance between the top of the wall angle 22 and the top of the beam connector 2.

FIG. 7 illustrates part of a suspended ceiling system incorporating the bridging connector 1 of FIG. 5 in another configuration. The beam connector 2 is connected to a bead 27 of a beam. The beam has a general inverted T-shape with a web 26 and flanges 25. Another beam is connected to the beam engagement element of the bridging connector using a screw 28.

In the embodiment shown the beam connector is a saddle type connector of mainly U-shape to straddle the top of the beam. Saddle type connectors enables a quick connection between the bridging connector and the beam. The saddle type connector may be configured for snap fit with the top of the beam. Further the saddle type connector may be configured to receiving an end of the beam in sliding engagement. Alternatively, the beam connector may be any suitable type of connector. In the simplest form the beam connector may be a plate portion with holes for screw connection to the beam.

The invention claimed is:

1. A bridging connector for a suspended ceiling system, comprising:

a beam connector joined to a wall engagement element arranged at an angle of essentially 90 degrees to the beam connector, the wall engagement element comprising a wall engagement portion, the beam connector being a saddle type connector of mainly U-shape, and the wall engagement element further comprising a depressed beam engagement portion, wherein the beam engagement portion forms a recess in the surface of the wall engagement element such that the beam engagement portion is configured to accommodate a bead of a bead, wherein the wall angle engagement portion comprises a first stop element and a second stop element, and wherein the first and second stop elements are steps formed in the wall angle engagement portion.

2. Bridging connector according to claim 1, wherein the beam engagement portion comprises a first abutment and a second abutment.

3. Bridging connector according to claim 2, wherein the recess has a lower bound and an upper bound, wherein the lower bound and upper bound are formed by the first abutment and the second abutment.

4. Bridging connector according to claim 2, wherein the wall angle engagement portion comprises a tongue off-set from a plane of the wall engagement element.

5. Bridging connector according to claim 1, wherein the wall engagement element further comprises fracture assistance weakenings.

6. Bridging connector according to claim 1, wherein the bridging connector is a unitary piece.

7. Bridging connector according to claim 1, wherein the bridging connector is made of sheet metal.

8. Bridging connector according to claim 7, wherein the bridging connector is made of thin gauge galvanized steel.

9. Bridging connector according to claim 1, wherein the wall engagement element comprises an aperture adapted for receiving a fastener.

10. Suspended ceiling system comprising the bridging connector according to claim 1, further comprising:

a first beam connected to the beam connector of the bridging connector, the first beam comprising a flange, a second beam connected to the beam engagement portion of the bridging connector, the second beam comprising a flange, a ceiling tile positioned on flanges of the first and second beams.

11. Suspended ceiling system according to claim 10, wherein the second beam has a bead which has an upper edge and a lower edge separated by a bead height, and wherein the beam engagement portion comprises a first abutment and a second abutment, the first abutment being lower than the second abutment, and the first and second abutments being separated by a beam engagement portion height and wherein the bead is arranged in the depressed beam engagement portion, and wherein the bead height is less than the beam engagement portion height, and wherein either (a) a lower edge of the bead is positioned abutting the first abutment or (b) an upper edge of the bead is positioned abutting the second abutment.

12. Suspended ceiling system comprising a bridging connector according to claim 2, further comprising a beam connected to the beam connector of the bridging connector, the first beam comprising a flange, a wall angle adapted for connection to a wall and engaging the wall angle engagement portion of the bridging connector, the wall angle further comprising a flange, a ceiling tile positioned on flanges of the beam and the wall angle.

13. Suspended ceiling system according to claim 12, wherein the wall angle engagement portion comprises a first stop element and a second stop element, wherein the first stop element is positioned below the beam engagement portion and the second stop element is positioned below the first stop element.

14. A bridging connector for a suspended ceiling system, comprising:

a beam connector joined to a wall engagement element arranged at an angle of essentially 90 degrees to the beam connector, the wall engagement element further comprising a depressed beam engagement portion, wherein the wall engagement element further comprises a wall angle engagement portion, wherein the wall angle engagement portion comprises a first stop element and a second stop element, wherein the beam engagement portion forms a recess in the surface of the wall engagement element such that the beam engagement portion is configured to accommodate the bead of a beam, and wherein the first and second stop elements are steps formed in the wall angle engagement portion.

15. Bridging connector according to claim 14, wherein the beam connector is a saddle type connector of mainly U-shape.

16. Suspended ceiling system comprising at least two bridging connectors, the bridging connectors having the same structure and each bridging connector comprising:

a beam connector joined to a wall engagement element arranged at an angle of essentially 90 degrees to the beam connector, the wall engagement element further comprising a depressed beam engagement portion, wherein the beam engagement portion forms a recess in the surface of the wall engagement element such that the beam engagement portion is configured to accommodate the bead of a beam, the suspended ceiling system comprising a first beam connected to the beam connector of a first bridging connector, the first beam comprising a flange, a second beam connected to the beam engagement portion of the first bridging connector, the second beam comprising a flange, a first ceiling tile positioned on flanges of the first and second beams a third beam connected to the beam connector of a second bridging connector, the third beam comprising a flange, a wall angle adapted for connection to a wall and engaging the wall angle engagement portion of the second bridging connector, the wall angle further comprising a flange, a second ceiling tile positioned on flanges of the third beam and the wall angle.

* * * * *